US011255217B2

(12) United States Patent
Landry

(10) Patent No.: US 11,255,217 B2
(45) Date of Patent: Feb. 22, 2022

(54) VANE ARM FOR VARIABLE VANES

(71) Applicant: United Technologies Corporation, Farmington, CT (US)

(72) Inventor: Daniel R. Landry, Brookfield, MA (US)

(73) Assignee: Raytheon Technologies Corporation, Farmington, CT (US)

( * ) Notice: Subject to any disclaimer, the term of this patent is extended or adjusted under 35 U.S.C. 154(b) by 78 days.

(21) Appl. No.: 16/573,001

(22) Filed: Sep. 17, 2019

(65) Prior Publication Data

US 2021/0079805 A1 Mar. 18, 2021

(51) Int. Cl.
*F01D 17/16* (2006.01)
*F04D 29/56* (2006.01)

(52) U.S. Cl.
CPC ..... *F01D 17/162* (2013.01); *F04D 29/563* (2013.01); *F05D 2220/32* (2013.01); *F05D 2230/64* (2013.01); *F05D 2260/74* (2013.01)

(58) Field of Classification Search
CPC .. F01D 17/162; F04D 29/563; F05D 2230/60; F05D 2230/64
USPC ..... 415/149.2, 149.4, 156, 159–162
See application file for complete search history.

(56) References Cited

U.S. PATENT DOCUMENTS

| | | | | |
|---|---|---|---|---|
| 3,954,349 | A | 5/1976 | Abild | |
| 4,979,874 | A | 12/1990 | Myers | |
| 5,492,446 | A | 2/1996 | Hawkins et al. | |
| 5,517,817 | A * | 5/1996 | Hines | F01D 17/162 415/115 |
| 6,699,010 | B2 * | 3/2004 | Jinnai | F01D 17/16 415/164 |
| 6,984,104 | B2 | 1/2006 | Alexander et al. | |
| 2004/0115045 | A1 * | 6/2004 | Alexander | F01D 17/162 415/165 |
| 2005/0135926 | A1 * | 6/2005 | Selby | F04D 29/563 415/160 |
| 2010/0092278 | A1 * | 4/2010 | Major | F01D 17/162 415/160 |
| 2014/0219785 | A1 * | 8/2014 | Gasmen | F04D 29/563 415/148 |
| 2015/0354401 | A1 * | 12/2015 | Morganti | F01D 17/162 415/124.1 |

* cited by examiner

*Primary Examiner* — Christopher Verdier
(74) *Attorney, Agent, or Firm* — Bachman & LaPointe, P.C.

(57) ABSTRACT

A variable vane actuation system for a gas turbine engine includes a stem section that forms a base and a contoured section that extends from the base along an axis. A vane arm comprising a claw section received onto the contoured section and a fastener fastened to the contoured section to load the claw section to the base.

12 Claims, 6 Drawing Sheets

VANE ARM FOR VARIABLE VANES

BACKGROUND

The present disclosure relates to a gas turbine engine and, more particularly, to a vane arm assembly therefor.

Gas turbine engines, such as those that power modern commercial and military aircraft, generally include a compressor section to pressurize an airflow, a combustor section to burn a hydrocarbon fuel in the presence of the pressurized air, and a turbine section to extract energy from the resultant combustion gases.

Some gas turbine engines include variable vanes that can be pivoted about their individual axes to change an operational performance characteristic. Typically, the variable vanes are robustly designed to handle the stress loads that are applied to change the position of the vanes. A mechanical linkage is typically utilized to rotate the variable vanes. Because forces on the variable vanes can be relatively significant, forces transmitted through the mechanical linkage can also be relatively significant. Variable vanes are mounted about a pivot and are attached to an arm that is in turn actuated to adjust each of the vanes of a stage. A specific orientation between the arm and vane is required to assure that each vane in a stage is adjusted as desired to provide the desired engine operation.

SUMMARY

A variable vane actuation system for a gas turbine engine according to one disclosed non-limiting embodiment of the present disclosure includes a stem section that forms a base and a contoured section that extends from the base along an axis; a vane arm comprising a claw section received onto the contoured section; and a fastener fastened to the contoured section to load the claw section to the base.

A further embodiment of any of the foregoing embodiments of the present disclosure includes that the contoured section is non-circular shaped.

A further embodiment of any of the foregoing embodiments of the present disclosure includes wherein the claw section comprises opposing fingers that are curved from an upper surface.

A further embodiment of any of the foregoing embodiments of the present disclosure includes that the upper surface further comprises a contoured aperture to receive the contoured section.

A further embodiment of any of the foregoing embodiments of the present disclosure includes that the opposing fingers each terminate at respective faces spaced from each other to define a claw opening that receives the contoured section, the faces configured to interface directly with opposing sides of the contoured section.

A further embodiment of any of the foregoing embodiments of the present disclosure includes that the vane is rotatable about the axis.

A further embodiment of any of the foregoing embodiments of the present disclosure includes that the stem extends from an outer trunion of a vane.

A further embodiment of any of the foregoing embodiments of the present disclosure includes that the vane comprises an airfoil.

A further embodiment of any of the foregoing embodiments of the present disclosure includes that the claw section comprises opposing fingers that are curved from an upper surface, wherein a distance between the upper surface and the opposing fingers subsequent to installing the bolt is less than a distance between the upper surface and the opposing fingers prior to installing the bolt.

A further embodiment of any of the foregoing embodiments of the present disclosure includes that the claw section is manufactured of sheet metal that is between 40-70 mils (1.0-1.8 mm) thick.

A further embodiment of any of the foregoing embodiments of the present disclosure includes that the outer diameter of the stem section is greater than an outer profile of the contoured section.

A further embodiment of any of the foregoing embodiments of the present disclosure includes that a difference in profile defines the base atop the stem section.

A further embodiment of any of the foregoing embodiments of the present disclosure includes that the stem section extends from a vane through an engine case.

A method of assembling a variable vane actuation system according to one disclosed non-limiting embodiment of the present disclosure includes preloading a claw section of a vane arm onto a base of a stem section of a vane along an axis of rotation of the stem section.

A further embodiment of any of the foregoing embodiments of the present disclosure includes that the preloading is performed by threading a bolt into a threaded bore in the stem section and compressing the claw section.

A further embodiment of any of the foregoing embodiments of the present disclosure includes providing a rotational lock interface between an upper surface of the claw section and a contoured section that extends from the base.

The foregoing features and elements may be combined in various combinations without exclusivity, unless expressly indicated otherwise. These features and elements as well as the operation thereof will become more apparent in light of the following description and the accompanying drawings. It should be appreciated; however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
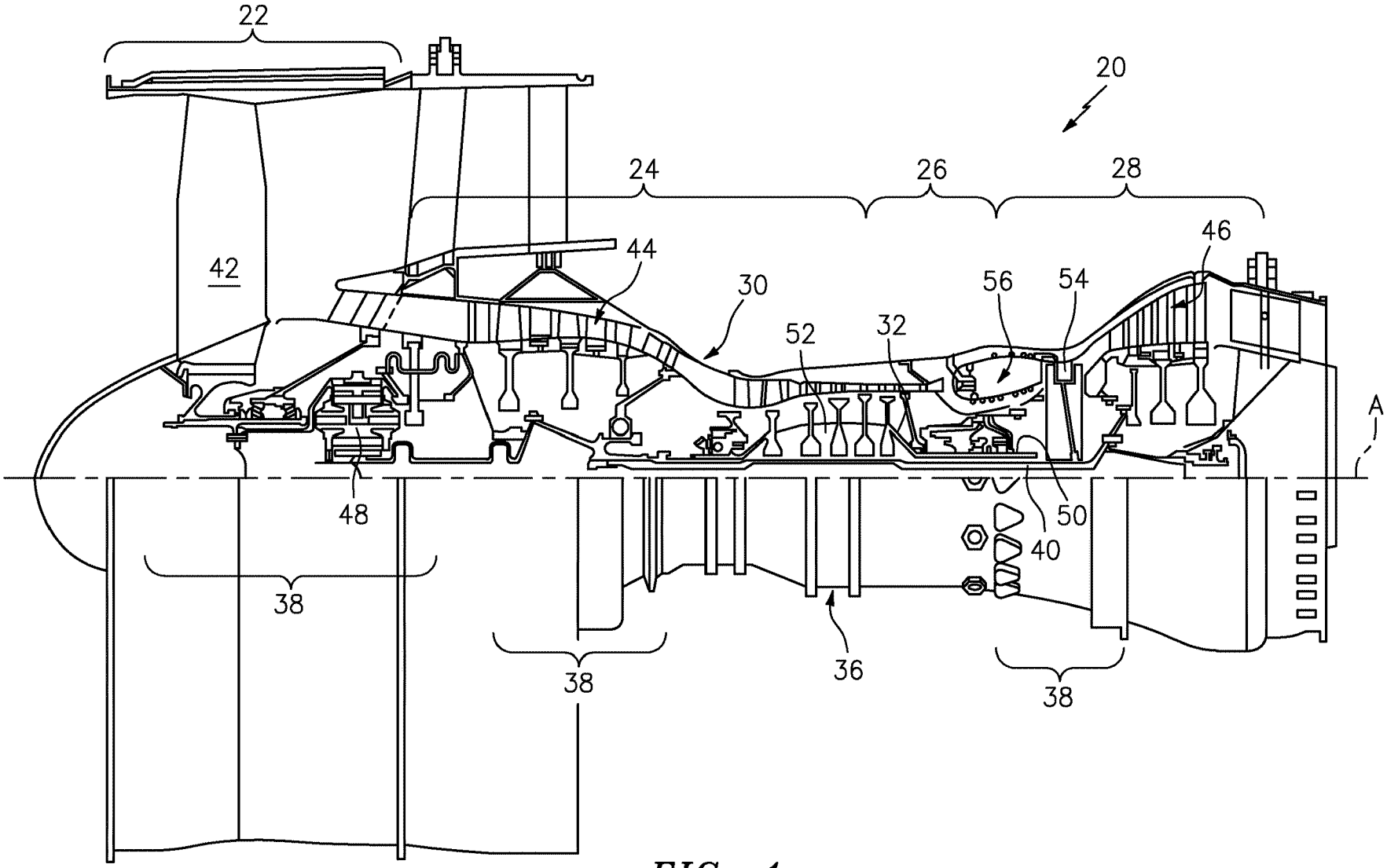
FIG. 1 is a schematic cross-section of an example gas turbine engine architecture.

FIG. 1 schematically illustrates a gas turbine engine 20. The gas turbine engine 20 is disclosed herein as a two-spool GTF (geared turbofan) that generally incorporates a fan section 22, a compressor section 24, a combustor section 26 and a turbine section 28. Alternative engine architectures might include an augmentor section and exhaust duct section (not shown) among other systems or features. The fan section 22 drives air along a bypass flowpath while the compressor section 24 drives air along a core flowpath for compression and communication into the combustor section 26 then expansion thru the turbine section 28. Although depicted as a GTF in the disclosed non-limiting embodiment, it should be understood that the concepts described herein are not limited to use with GTF as the teachings may be applied to other types of turbine engines such as a Direct-Drive-Turbofan with high, or low bypass augmented turbofan, turbojets, turboshafts, and three-spool (plus fan) turbofans wherein an intermediate spool includes an intermediate pressure compressor ("IPC") between a Low Pressure Compressor ("LPC") and a High Pressure Compressor ("HPC"), and an intermediate pressure turbine ("IPT") between the high pressure turbine ("HPT") and the Low pressure Turbine ("LPT").

The engine 20 generally includes a low spool 30 and a high spool 32 mounted for rotation about an engine central longitudinal axis A relative to an engine static structure 36 via several bearing compartments 38. The low spool 30 generally includes an inner shaft 40 that interconnects a fan 42, a low pressure compressor 44 ("LPC") and a low pressure turbine 46 ("LPT"). The inner shaft 40 drives the fan 42 directly or thru a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor 52 ("HPC") and high pressure turbine 54 ("HPT"). A combustor 56 is arranged between the HPC 52 and the HPT 54. The inner shaft 40 and the outer shaft 50 are concentric and rotate about the engine central longitudinal axis A which is collinear with their longitudinal axes.

Core airflow is compressed by the LPC 44 then the HPC 52, mixed with fuel and burned in the combustor 56, then expanded over the HPT 54 and the LPT 46. The turbines 54, 46 rotationally drive the respective low spool 30 and high spool 32 in response to the expansion. The main engine shafts 40, 50 are supported at a plurality of points by the bearing compartments 38. It should be understood that various bearing compartments 38 at various locations may alternatively or additionally be provided.

In one example, the gas turbine engine 20 is a high-bypass geared aircraft engine with a bypass ratio greater than about six (6:1). The geared architecture 48 can include an epicyclic gear train, such as a planetary gear system or other gear system. The example epicyclic gear train has a gear reduction ratio of greater than about 2.3:1, and in another example is greater than about 3.0:1. The geared turbofan enables operation of the low spool 30 at higher speeds which can increase the operational efficiency of the LPC 44 and LPT 46 to render increased pressure in relatively few stages.

A pressure ratio associated with the LPT 46 is pressure measured prior to the inlet of the LPT 46 as related to the pressure at the outlet of the LPT 46 prior to an exhaust nozzle of the gas turbine engine 20. In one non-limiting embodiment, the bypass ratio of the gas turbine engine 20 is greater than about ten (10:1), the fan diameter is significantly larger than that of the LPC 44, and the LPT 46 has a pressure ratio that is greater than about five (5:1). It should be understood, however, that the above parameters are only exemplary of one embodiment of a geared architecture engine and that the present disclosure is applicable to other gas turbine engines including direct drive turbofans, where the rotational speed of the fan 42 is the same (1:1) as the LPC 44.

In one example, a significant amount of thrust is provided by the bypass flow path due to the high bypass ratio. The fan section 22 of the gas turbine engine 20 is designed for a particular flight condition—typically cruise at about 0.8 Mach and about 35,000 feet (10668 meters). This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The relatively low Fan Pressure Ratio according to one example gas turbine engine 20 is less than 1.45. Low Corrected Fan Tip Speed is the actual fan tip speed divided by an industry standard temperature correction of $(\text{"T"}/518.7)^{0.5}$ in which "T" represents the ambient temperature in degrees Rankine. The Low Corrected Fan Tip Speed according to one example gas turbine engine 20 is less than about 1150 fps (351 m/s).

Figure 2:
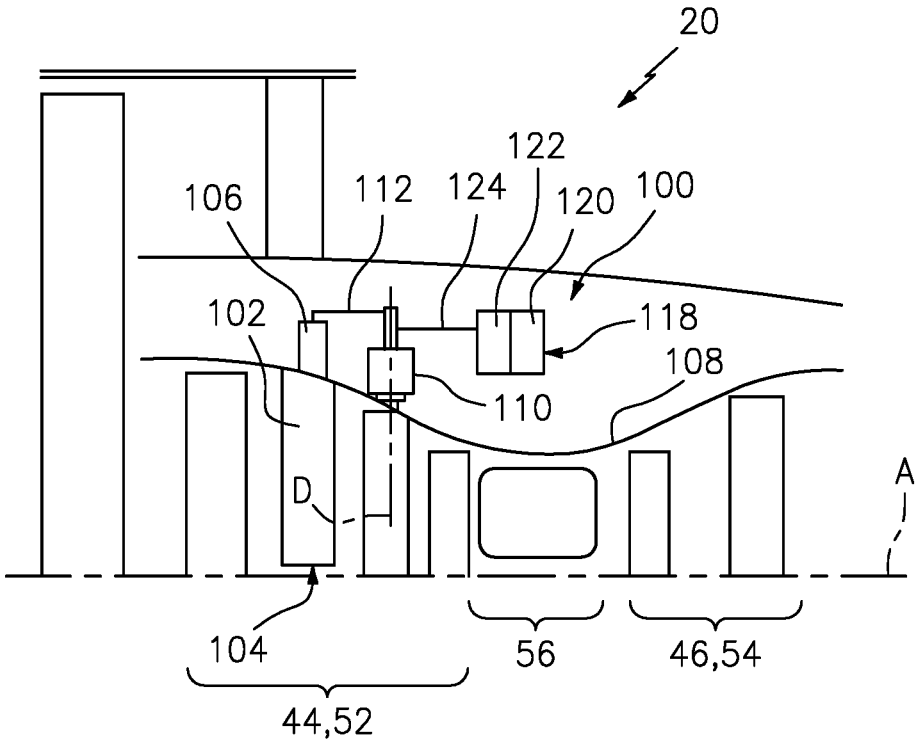
FIG. 2 is a schematic view of a variable vane system for a gas turbine engine.

With reference to FIG. 2, one or more stages of the LPC 44 and/or the HPC 52 include a variable vane system 100 that can be rotated to change an operational performance characteristic of the gas turbine engine 20 for different operating conditions. The variable vane system 100 may include one or more variable vane stages.

The variable vane system 100 may include a plurality of variable vanes 102 (also shown in FIG. 3) circumferentially arranged around the engine central axis A. The variable vanes 102 each include a variable vane body that has an airfoil portion such that one side of the airfoil portion generally operates as a suction side and the opposing side of the airfoil portion generally operates as a pressure side. Each of the variable vanes 102 generally spans the core flow path between an inner diameter and an outer diameter relative to the engine central axis A.

Figure 3:
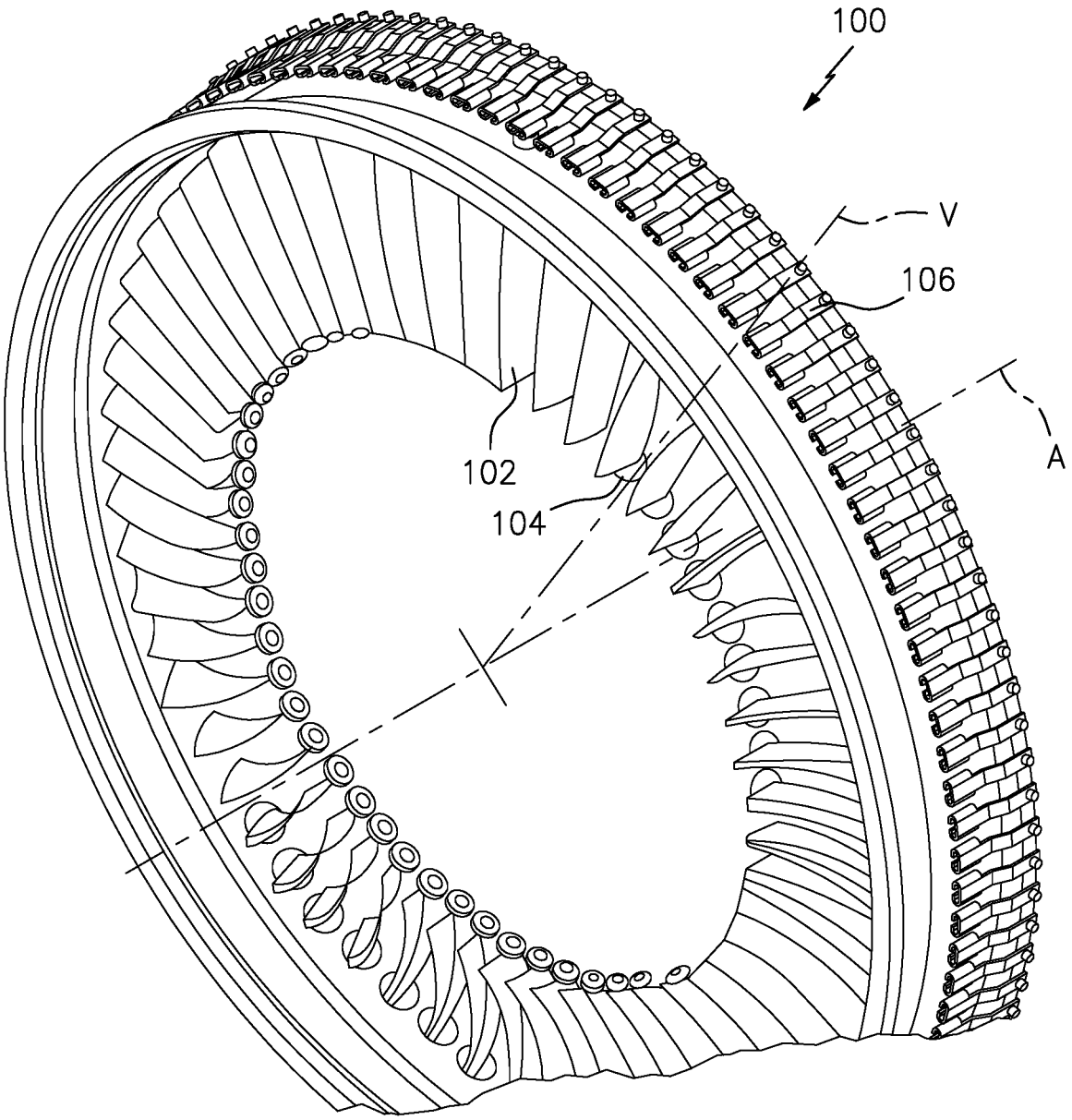
FIG. 3 is a partial perspective view of one stage of a variable vane system for a gas turbine engine.

Each of the variable vanes 102 includes an inner trunion 104 that is receivable into a corresponding socket and an outer trunion 106 mounted through an outer engine case 108 such that each of the variable vanes 102 can pivot about a vane axis V (FIG. 3).

The variable vane system 100 further includes a synchronizing ring assembly 110 to which, in one disclosed non-limiting embodiment, each of the outer trunions 106 are attached through a vane arm 112 along a respective axis T. It should be appreciated that although a particular vane arm 112 is disclosed in this embodiment, various linkages of various geometries may be utilized.

Figure 4:
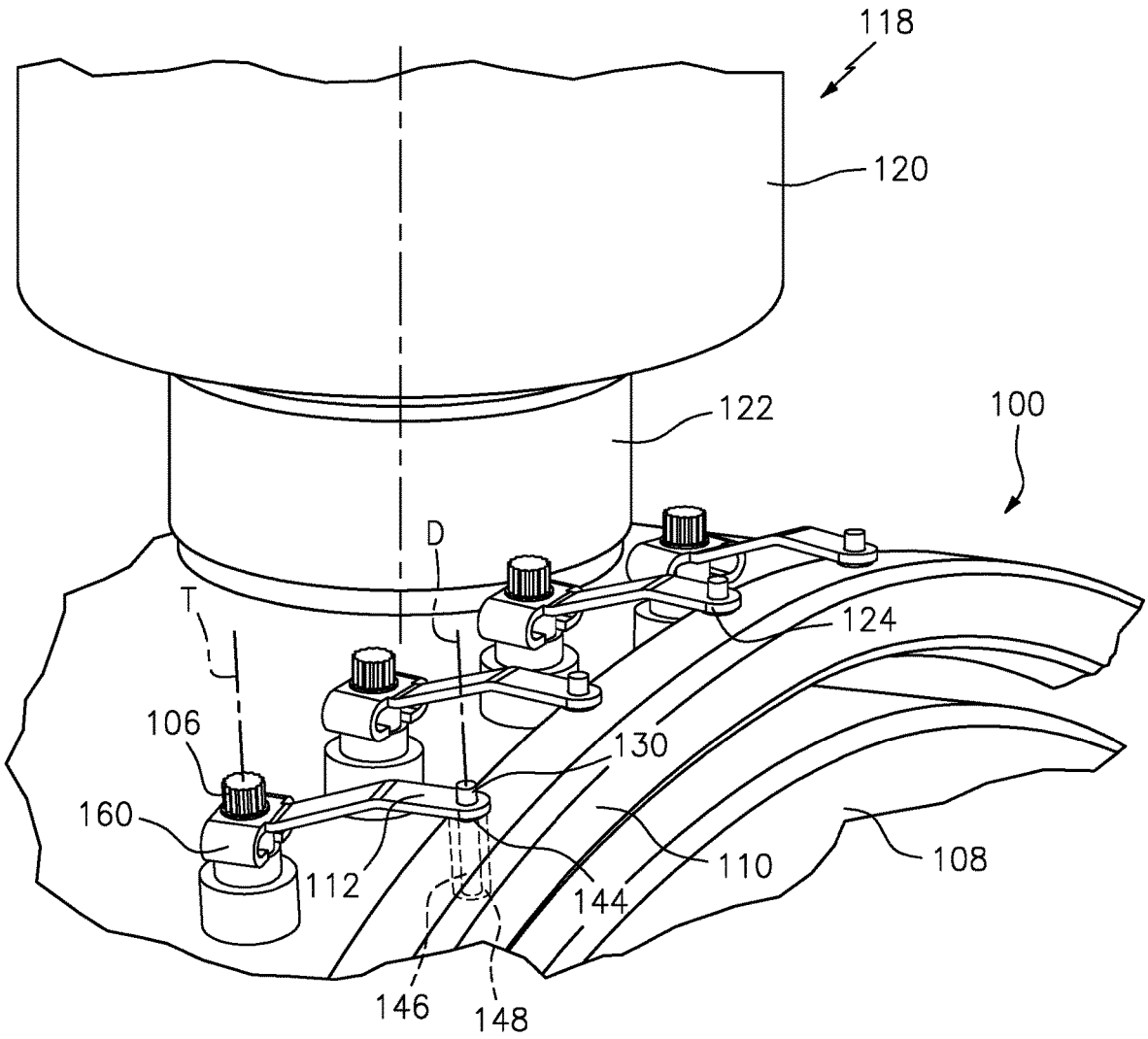
FIG. 4 is a partial perspective view of a variable vane system for a gas turbine engine according to one disclosed non-limiting embodiment.

The variable vane system 100 is driven by an actuator system 118 with an actuator 120, a drive 122 and an actuator arm 124 (also shown in FIG. 4). Although particular components are separately described, it should be appreciated that alternative or additional components may be provided.

With reference to FIG. 4, the vane arm 112 links each outer trunion 106 to the synchronizing ring assembly 110. Rotation of the synchronizing ring assembly 110 about the engine axis A (FIG. 1) drives the vane arm 112 to rotate the outer trunion 106 of each of the variable vanes 102.

Each vane arm 112 interfaces with the synchronizing ring assembly 110 via a pin 130. The pin 130 is swaged to an end section 140 of the vane arm 112 within an aperture. A collar 144 of the pin 130 may be utilized to locate the pin 130 at an appropriate depth prior to swaging. The pin 130 is received within a bushing 146 that fits within a sleeve 148 in the synchronizing ring assembly 110. The bushing 146 permits the pin 130 and the vane arm 112 to rotate together relative to the synchronizing ring assembly 110.

Figure 5:
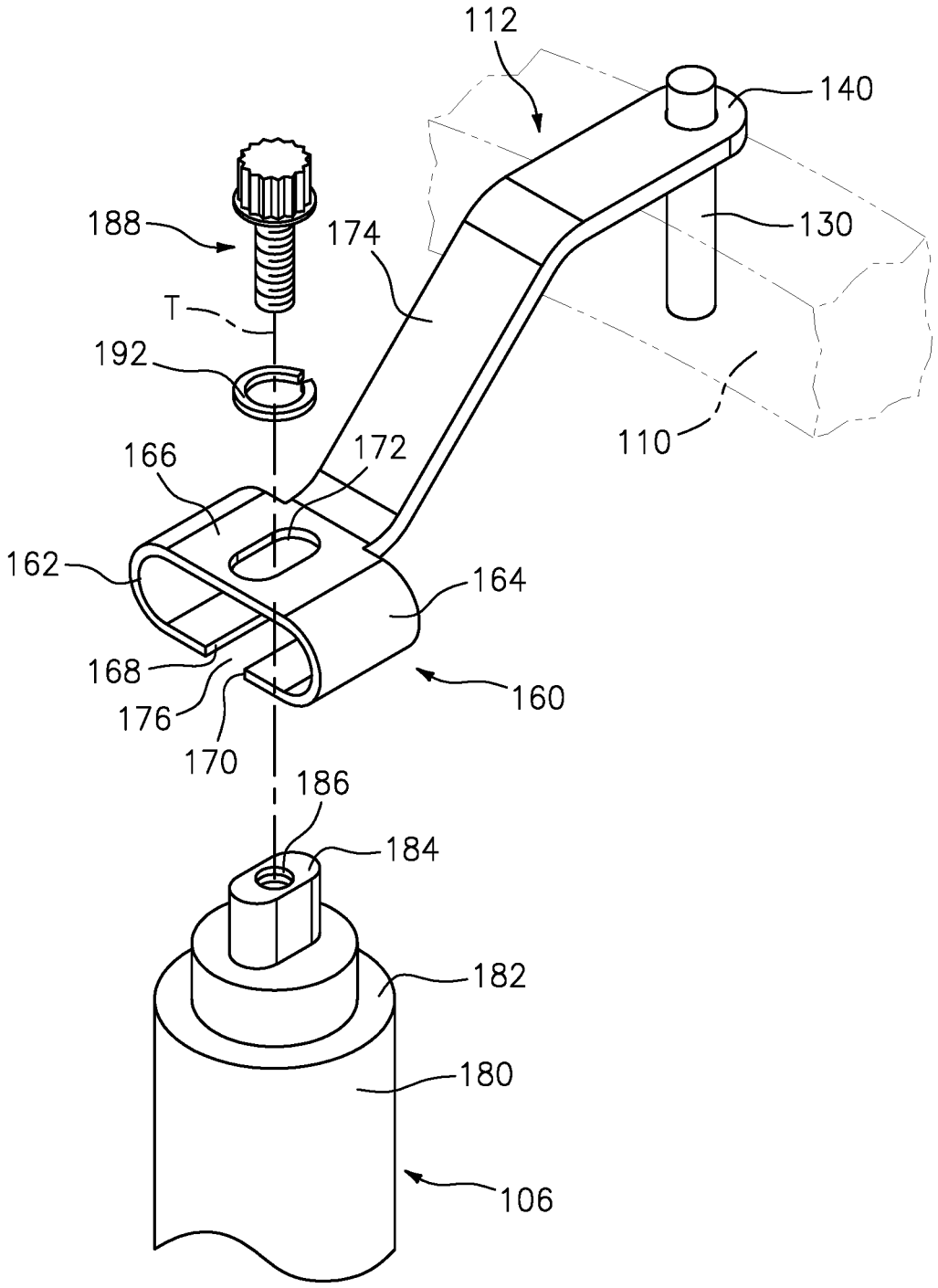
FIG. 5 is an exploded view of an interface between one variable vane and a vane arm according to one disclosed non-limiting embodiment.

With reference to FIG. 5, each vane arm 112 also interfaces with its respective stator vane 102 via a claw section 160 opposite the end section 140 to rotate the outer trunion 106. The claw section 160 includes opposing fingers 162, 164 that are curved from an upper surface 166 and terminate at respective opposed faces 168, 170. The upper surface 166 extends from an arm 174 and includes a contoured aperture 172 which, in this embodiment, is a non-circular shaped slot, e.g., race track, oblong, oval, rectilinear, etc. Each vane arm 112 may be manufactured of a sheet metal material that is between 40-70 mils (1.0-1.8 mm) thick. The opposed faces 168, 170 are spaced to provide an opening 176 that interfaces with the outer trunion 106.

The outer trunion 106 includes a stem section 180 that forms a base 182, and a contoured section 184 which, in this embodiment, is a non-circular shape to fit into the contoured aperture 172. The stem section 180 and the contoured section 184 are defined along the vane axis T of the outer trunion 106. An outer diameter of the stem section 180 is greater than an outer profile of the contoured section 184 to form the base 182 as a step in the outer trunion 106. That is, the difference in profile defines the base 182 atop the stem section 180.

Figure 6B:
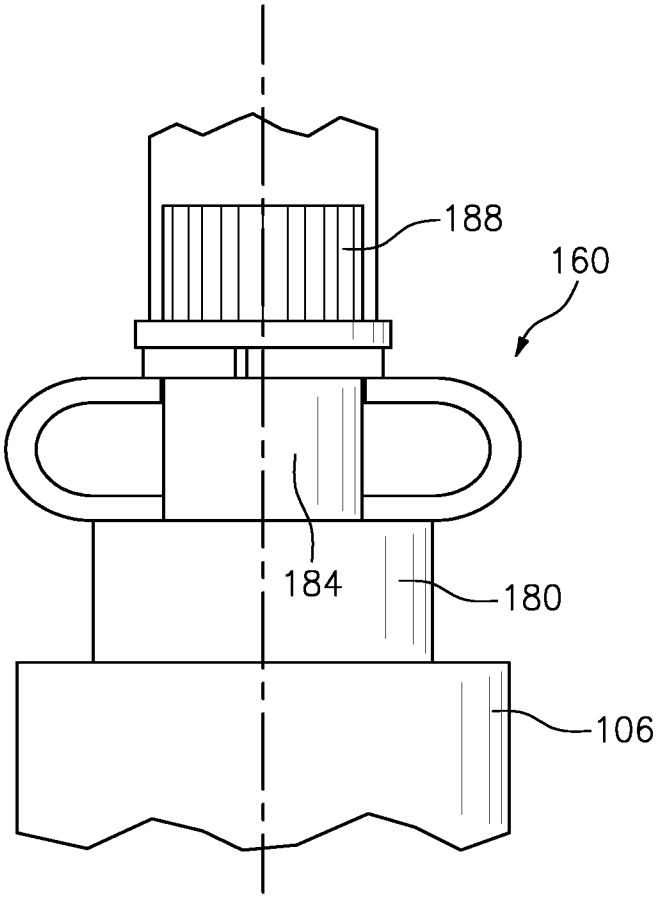
FIG. 6B is a sectional view of the interface subsequent to installation of the bolt which compresses the claw section of the vane arm.
Figure 6A:
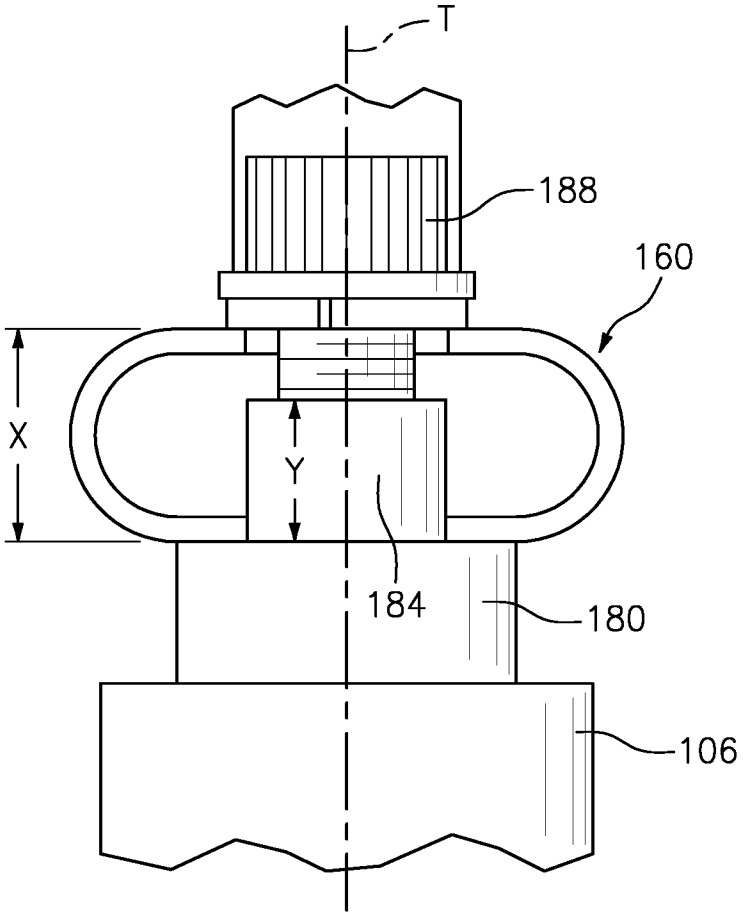
FIG. 6A is a sectional view of the interface prior to installation of a bolt.

A threaded bore 186 is defined through the stem section 180 and the contoured section 184 along the axis T. The threaded bore 186 receives a bolt 188 that retains the vane arm 112 to the outer trunion 106 and compresses the claw section 160 onto the base 182 (FIGS. 6A and 6B). A lock washer 192 may be located between the bolt head and the claw section 160.

A height X between the opposing fingers 162, 164 and the upper surface 166 is greater than a height Y of the contoured section 184 from the base 182 (FIG. 6A). That is, the opposing fingers 162, 164 and the upper surface 166 operate as a spring washer with respect to the base 182 when preloaded by the bolt 188 when torqued into the threaded bore 186 (FIG. 6B).

Assembling the variable vane actuation system is readily achieved when the bolt 188 that retains the vane arm 112 to the outer trunion 106 preloads the claw section 160 of the vane arm 112 onto the base 182 of the stem section 180 along the axis of rotation of the stem section 160. The interface between the contoured section 184 and the contoured aperture 172 provide a rotational lock interface. The opposed faces 168 and 170 also provide a clamping interface with flats of the contoured section 184. These interfaces and the spring washer effect of the claw section 160 readily increases the orientation, retention, and the force transmission capability between the vane arm 112 and the outer trunion 106.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason, the appended claims should be studied to determine true scope and content.

What is claimed is:

1. A variable vane actuation system for a gas turbine engine, comprising:

a stem section of a vane that forms a base and a contoured section that extends from the base along an axis;

a vane arm comprising a claw section received onto the contoured section, the claw section comprises opposing fingers that are curved from an upper surface, the upper surface comprises a contoured aperture to receive the contoured section providing a rotational lock interface, wherein the opposing fingers each terminate at respective faces spaced from each other to define a claw opening that receives the contoured section, the faces configured to interface directly with opposing sides of the contoured section; and a fastener that extends through the contoured aperture and into the contoured section which compresses the opposing fingers of the claw section along the axis, a distance between the upper surface and the opposing fingers subsequent to installing the fastener is less than a distance between the upper surface and the opposing fingers prior to installing the fastener.

2. The system as recited in claim 1, wherein the contoured section and the contoured aperture are non-circular shaped.

3. The system as recited in claim 1, wherein the vane is rotatable about the axis.

4. The system as recited in claim 1, wherein the stem extends from an outer trunnion of the vane.

5. The system as recited in claim 4, wherein the vane comprises an airfoil.

6. The system as recited in claim 1, wherein the claw section is manufactured of sheet metal that is between 40-70 mils (1.0-1.8 mm) thick.

7. The system as recited in claim 6, wherein a difference in profile defines the base atop the stem section.

8. The system as recited in claim 6, wherein the stem section extends from the vane through an engine case.

9. The system as recited in claim 1, wherein the outer diameter of the stem section is greater than an outer profile of the contoured section.

10. The system as recited in claim 1, wherein the contoured section and the contoured aperture are race-track shaped.

11. A method of assembling a variable vane actuation system, comprising:

preloading a claw section of a vane arm onto a base of a stem section of a vane along an axis of rotation of the stem section such that a contoured aperture of the claw section receives a contoured section of the stem section providing a rotational lock interface, wherein the preloading is performed by threading a fastener into a threaded bore in the stem section along the axis such that a distance between an upper surface of the claw section and opposing fingers of the claw section subsequent to installing the fastener is less than a distance between the upper surface and the opposing fingers prior to installing the fastener, wherein the fastener compresses the opposing fingers of the claw section along the axis.

12. The method as recited in claim 11, further comprising providing the rotational lock interface between the upper surface of the claw section and the contoured section that extends from the base.

* * * * *